US005660597A

United States Patent [19]

Fox et al.

[11] Patent Number: 5,660,597

[45] Date of Patent: Aug. 26, 1997

[54] VIBRATORY CHILD PACIFYING DEVICE

[76] Inventors: Lawrence A. Fox, 10734 Nadine, Huntington Woods, Mich. 48070; James Chang, 11 W. Emerson, Arlington Heights, Ill. 60005; Stanley M. Kujawski, 112 Elmwood Ave., East Aurora, N.Y. 14052

[21] Appl. No.: 439,439

[22] Filed: May 11, 1995

Related U.S. Application Data

[63] Continuation of Ser. No. 132,723, Oct. 6, 1993, abandoned, which is a continuation-in-part of Ser. No. 953,426, Sep. 29, 1992, abandoned.

[51] Int. Cl.[6] ..... A61H 1/00

[52] U.S. Cl. ..... 601/49; 601/56; 601/58; 601/59; 601/60

[58] Field of Search ..... 601/49, 56, 57, 601/58, 59, 60, 70, 80

[56] References Cited

U.S. PATENT DOCUMENTS

| | | | |
|---|---|---|---|
| D. 320,023 | 9/1991 | Gault . | |
| 2,463,110 | 3/1949 | Johnson . | |
| 2,587,207 | 2/1952 | Peterson . | |
| 2,932,821 | 7/1960 | Horton . | |
| 3,037,499 | 6/1962 | Cummins . | |
| 3,101,972 | 8/1963 | Laughlin . | |
| 3,203,415 | 8/1965 | Moore . | |
| 3,206,247 | 9/1965 | Johnson . | |
| 3,235,891 | 2/1966 | Chade et al. . | |
| 3,272,556 | 9/1966 | Rocker . | |
| 3,311,935 | 4/1967 | Petty | 601/59 |
| 3,334,944 | 8/1967 | Gould et al. . | |
| 3,455,296 | 7/1969 | McCaleb . | |
| 3,464,405 | 9/1969 | Kallus . | |
| 3,811,430 | 5/1974 | Kawakami . | |
| 3,841,320 | 10/1974 | Brown, Jr. . | |
| 3,915,189 | 10/1975 | Holbrook et al. | 604/319 |
| 3,928,894 | 12/1975 | Bury et al. . | |
| 3,948,379 | 4/1976 | Warner . | |
| 4,136,685 | 1/1979 | Ramey . | |
| 4,141,095 | 2/1979 | Adachi . | |
| 4,258,706 | 3/1981 | Shank . | |
| 4,558,905 | 12/1985 | Natori . | |
| 4,620,334 | 11/1986 | Robinson . | |
| 4,681,096 | 7/1987 | Cuervo | 601/60 |
| 4,785,797 | 11/1988 | Cuervo . | |
| 4,920,583 | 5/1990 | Hough et al. . | |
| 4,947,832 | 8/1990 | Blitzer . | |
| 4,979,777 | 12/1990 | Takada . | |
| 5,007,410 | 4/1991 | DeLaney . | |
| 5,014,687 | 5/1991 | Raffel . | |
| 5,020,517 | 6/1991 | Foster, Jr. et al. . | |
| 5,022,384 | 6/1991 | Freels et al. . | |
| 5,033,458 | 7/1991 | Speer . | |
| 5,074,820 | 12/1991 | Nakayama . | |
| 5,086,755 | 2/1992 | Schmid-Eilber . | |
| 5,094,225 | 3/1992 | Craw . | |
| 5,147,109 | 9/1992 | Jolly . | |
| 5,181,023 | 1/1993 | Fuji | 601/78 |
| 5,184,607 | 2/1993 | Hwang . | |

OTHER PUBLICATIONS

Advertisement in Juvenile Merchandising, Sep. 1992, for "Soothe 'N Snooze Baby Sleeper".

Advertisement appearing in 1992 (specific publication & date unknown) for "Crib Rocker".

*Primary Examiner*—Robert A. Hafer
*Assistant Examiner*—Benjamin Koo
*Attorney, Agent, or Firm*—Juettner Pyle Lloyd & Piontek

[57] ABSTRACT

A portable, compact, self-contained child pacifying device is disclosed for use with infant support structures. The device may be attached to such infant support structures through attachment means allowing ready attachment and removal of the pacifying device. The attachment means may include projecting tabs or a pivotable retaining arm located proximate a vibration dampening means. A biasing means retains the attachment means and the pacifying device in position. The device comprises an integral outer case structure within which a battery powered vibratory source is mounted to produce a vibrating motion. The outer case structure attaches to the child carrier through a mounting arrangement fixedly attached to the exterior of the case structure and attachable to the infant support structure.

21 Claims, 9 Drawing Sheets

FIG. 8
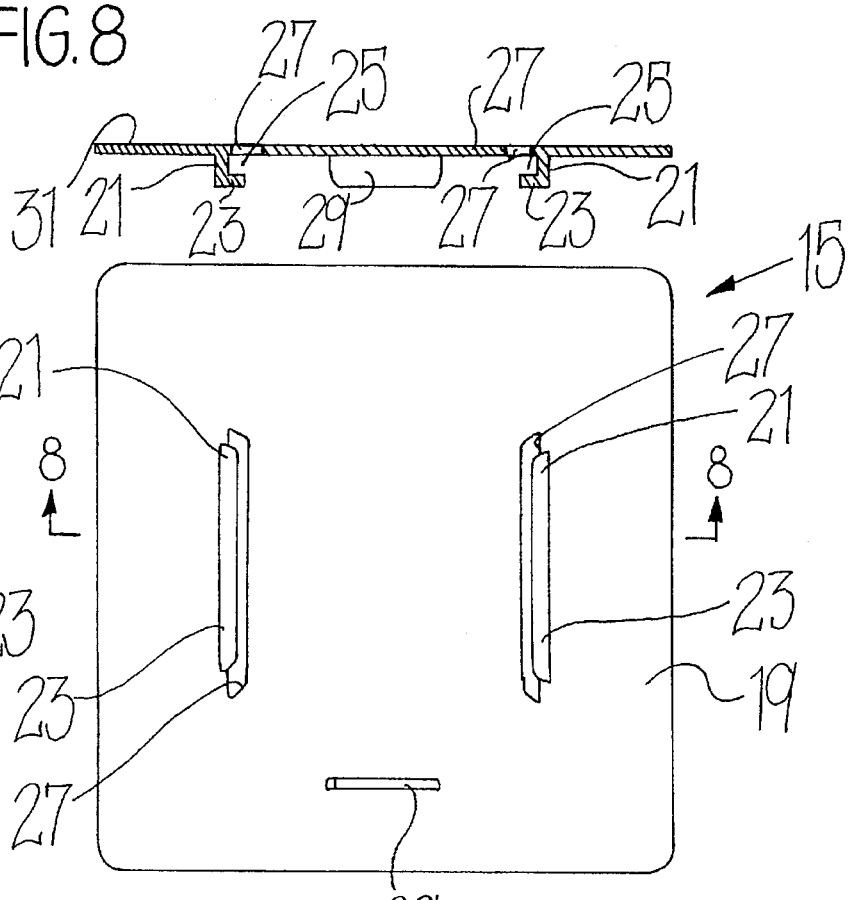
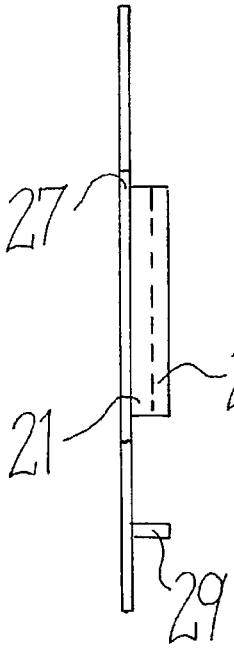
FIG. 9
FIG. 7

FIG. 11
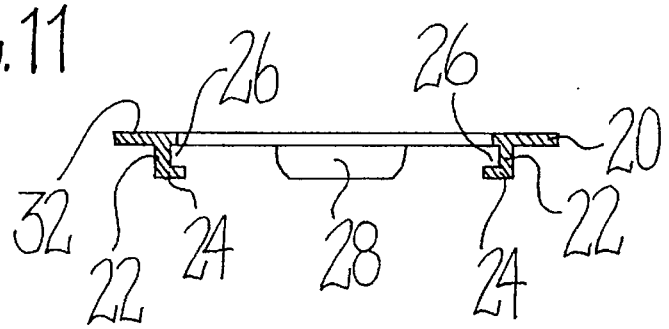
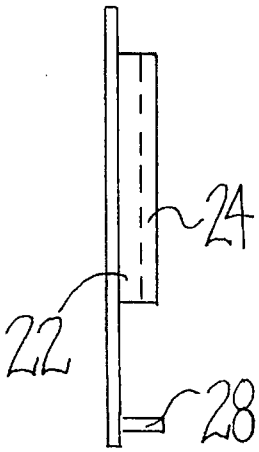
FIG. 12
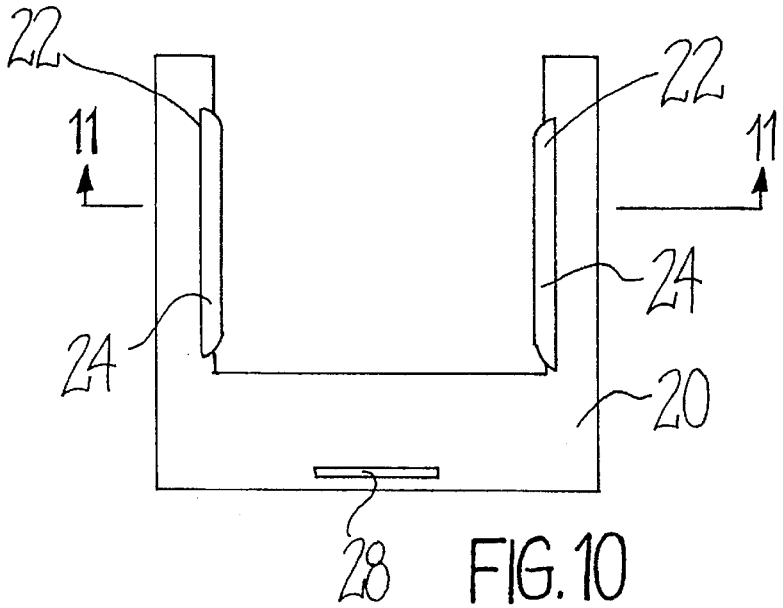
FIG. 10

VIBRATORY CHILD PACIFYING DEVICE

This is a continuation of application Ser. No. 08/132,723, filed on Oct. 6, 1993, now abandoned, which is a continuation-in-part application of U.S. patent application No. 07/953,426, filed Sep. 29, 1992, abandoned.

BACKGROUND OF THE INVENTION

1. Field of the Invention

The present invention relates to a device for soothing and pacifying a crying or fussy infant, and more particularly, to a portable vibrating unit suitable for attachment to virtually any structure for supporting an infant for soothing the infant in the same manner as that which is believed to occur in an automobile.

2. Description of the Prior Art

Parents the world over are well familiar with the general discomfort experienced by newborn infants, as they make the transition from developing as a fetus inside the mother's womb to being a baby in the outside world. This discomfort, which typically exists for the first three to six months of the baby's life, is widely believed to be the result of the abrupt transition from the womb to the new environment outside the womb. This new environment is manifestly different from the environment the infant experienced as a fetus inside the womb. It has been found, in easing this transition, that soothing infants outside of the womb is of great value and can be achieved by creating an environment that simulates the conditions inside the womb. The most effective and practical way to do this is through movement.

As a result of having to make the adjustment to a new life outside of the womb, it is quite common for all infants to cry. It is these infants, that need soothing now and then, to which the present invention is directed. Colicky infants, who cry more than normal due to reasons other than a new environment, can also benefit from this invention.

Several attempts, therefore, have been made over the years to remedy to discomfort of these infants, especially colicky infants, and soothe the nerves of the attending parents.

In their most basic forms, these attempts include holding, rocking, jiggling, and cuddling infants in an adult's arm. Other remedies include the use of swings or rocking cribs, as pieces of "moving furniture", to help soothe young children. However, such devices are typically quite bulky, difficult to transport, and impart a gross motion to the seating platform or crib, typically requiring adult supervision during use.

Moreover, the effectiveness of these remedies is not always apparent. The disadvantages and inconveniences of such attempts are clear, especially when the parents may otherwise be preoccupied, such as in a restaurant setting. Other parents have discovered that infants, when exposed to the motion and vibration of automobiles, often seem to be soothed and relieved of their discomfort. Thus, it is not uncommon for parents to take uncomfortable infants in automobile rides solely to provide this relief.

There have thus been extensive efforts to artificially simulate an automobile motion and sound, such as that disclosed in Cuervo U.S. Pat. No. 4,681,096. Cuervo primarily discloses a child pacifying device having an electric motor mounted to a base of a housing. The device is considered to have quite limited utility, in that the housing can only be attached to the springs of an infant crib. Moreover, Cuervo further discloses and claims the need for a random noise sound generator providing frequencies between 200 and 4000 Hz at intensities of 60 and 80 db as necessary to complete the simulation of an automobile traveling at 45 to 55 mph.

Currently, available products in this art include the "Crib Rocker", a self-contained battery operated child pacifying device for attachment to the side rails of a child's crib for simulating the motion of an automobile. However, each of the devices suggest that the vibratory source must be combined with additional stimulatory sources, such as sound generators or a traveling sine wave.

Other approaches for infant soothing include Horton. U.S. Pat. No. 2,932,8321, which discloses an infant pacifying device comprising an electrical buzzer or small electric motor providing vibratory motion and audible buzzing. However, in operation, the vibration source is simply placed on that same surface on which an infant is supported. Thus, there was no solution offered which rendered Horton applicable to the wide range of child support structures available in the current market. These include, inter alia, child safety seats, rockers, swings, and the multitude of relatively lightweight child carriers now popular with parents. Moreover, Horton offered no means to reduce the harshness of the vibration or noise generated.

Thus, basic vibratory devices are known. However, none disclose or suggest convenient and virtually universal attachment to and ready removal from a wide variety of infant support structures. Further, none discuss or suggest an amplitude damping means in combination with an attachment means. In contrast, such devices are limited to use with a horizontal surface, e.g., a mattress. None suggest use of the vibratory unit with an infant support structure. Further, these systems clearly do not disclose or suggest any dampening means or disclose or suggest biasing means allowing for attachment or easy removal of the device.

Moreover, various mounting systems for attaching an item to a larger article are known. Virtually all such systems involve non-analogous art. Some systems depend solely on the force of gravity. Such systems typically lack a biasing means allowing easy removal of the item from the article. Importantly, none disclose or suggest the combination herein claimed. None disclose or suggest the use for a dampening means associated with an attachment means of attaching a vibratory source to an infant support structure. The present invention thus provides a great advantage over the prior art in an art where great demand exists.

It is currently believed that over 6 million total child safety seats were sold in the U.S. in 1990. Infant carrier safety seats, an example of an infant support structure suitable for use with the present invention, represented approximately 33 percent of the total child safety seats sold, or 2 million seats in 1990. The percentage of infant carrier car seats sold, as compared to the total number of car seats sold, is steadily rising. These seats, as well as other infant support structures, are popular products for carrying an infant because of the versatility they give parents and, in most states, due to automobile child safety seat use laws requiring an approved safety seat for all small children traveling in automobiles. These products, which are designed to accommodate an infant who weighs 20 pounds or less, are comfortable for an infant that does not have complete control over its muscle coordination. Additionally, there exist infant support structures which are not designed or constructed for use as a car seat, but provide the same functional versatility for the parents. These other infant support structures are also suitable for use with the present invention.

Thus, an effort was made to overcome the shortcomings of prior attempts to soothe infants and add significant refinement to the vibratory sources of the prior art by virtue of the utility, adaptability, portability, compactness, internal power, relatively low cost, and elimination of additional stimulatory sources such as disclosed and claimed herein. The desire to create such a child pacifying device, and the ubiquitous features of most infant support structures already in use due to their convenience, resulted in the present invention, where a simple pacifying device is adaptable for mounting and use with virtually any infant support structure and is thus suitable for all environments by virtue of its portability and ease of application to such infant support structures.

SUMMARY OF THE INVENTION

In accordance with this invention, the above-discussed disadvantages of devices intended to soothe and pacify uncomfortable infants are overcome by a child pacifying device especially suited for use with a wide range of infant support structures. The device is adapted to be attached to the infant support structure through various attachment means. Thus, according to the present invention, a portable, compact self-contained child pacifying device for attachment to an infant support structure includes an outer case structure operatively containing therein a battery-operated vibratory source. Attachment means, adapted for frequent and repeated use without the need for any tools, attach the vibratory source to a portion of infant support structure allowing ready attachment and removal of the vibratory source from an exterior portion of the infant support structure. An amplitude dampening means is located proximate the attachment means such that the amplitude dampening means is mechanically situated between a portion of the attachment means and the exterior portion of the child support structure to dampen vibrations emanating from the vibratory source. Biasing means associated with the attachment means bias the amplitude dampening means into contact with the infant support structure, where the biasing means allows the ready attachment and removal of the vibratory source from the infant support structure without the need for tools or other accessories.

In a first embodiment of the present invention, mounting tabs are located symmetrically around the amplitude dampening means, comprising a dampening pad, which engage corresponding notches in a mounting bracket. The ideal location for this embodiment is the rear back portion of a child safety seat, opposite the small of the infant's back. Adaptation to this area provides for the lowest center of gravity suitable for affixing the invention. The mounting bracket is fashioned to slidingly engage the tabs for repeated engagement and disengagement. The amplitude dampening means also tends to bias the tab/notch interface into an engaged position. Thus, an advantage of the present invention is that the vibration source may be removed from one infant support structure and installed on another fitted with the mounting bracket to thereby allow the use of the present invention without incurring the cost of a vibratory source for every infant support structure, while maintaining comfort of the amplitude dampening means mounted on the outer case structure with the infant support structure. The device is further situated such that the amplitude dampening means is located proximate the motor in the vibratory source. Thus, the vibration is primarily transmitted through the amplitude dampening means from the vibratory source to the infant support structure as a whole.

However, due to the variability in infant support structures, not all infant carriers have a suitable flat surface in this area. In these cases, a further embodiment of the present invention can be utilized for effective attachment to any exposed portion of the infant support structure. In this embodiment, the attachment means includes a pivotable retaining arm which is securely affixed to the housing of the vibratory source. One end of the retaining arm is adapted to engage virtually any exposed portion of the infant support structure, while maintaining contact of the amplitude dampening means mounted on the outer case structure with the infant support structure. The Opposite end is adapted to be manually manipulated to pivot the retaining arm into and out of engagement with the infant support structure. A biasing means retains the retaining arm in engaging contact with the exposed portion of the infant support structure.

Thus, an advantage of the present invention allowing removal of the vibration source from one infant support structure for subsequent installation on another without incurring the cost of a vibratory source for every infant support structure is maintained. As noted above, this embodiment is likewise provided with an amplitude dampening means mounted on the arm in contact with the infant support structure and located proximate the motor in the vibratory source. Thus, the vibration is primarily transmitted through the amplitude dampening means from the vibratory source to the infant support structure as a whole.

Thus, a present object of the present invention is to provide a portable, effective, safe, and inexpensive child pacifying device to alleviate the discomfort of an infant through vibrational soothing.

Another object of this invention is to provide a child pacifying device that requires no externally provided power source and is capable of operating through only an internally stored power supply.

Still another object of the present invention is to provide a child pacifying device compatible with existing and future infant support structures and can thus be used anywhere such infant support structures are used.

Another object of the present invention is to provide a child pacifying device that is of a unitary construction of relatively low cost and high impact resistance in accordance with the foregoing objects.

A further object of the present invention is to provide a child pacifying device which may be removed from one infant support structure and installed on another infant support structure to thereby allow the use of the present invention without incurring the cost of a separate vibratory source for every infant support structure.

A still further object of the present invention is to provide a child pacifying device wherein the case structure further incorporates a dampening means to significantly lessen the gross oscillatory motion of the vibratory source.

An additional object of the present invention is to provide a child pacifying device further comprising a means to vary the intensity of the vibratory source.

Still another object of the present invention is to provide a child pacifying device Wherein the vibratory amplitude is attenuated by the presence of dampening material.

A further object of the present invention is to provide a child pacifying device wherein the vibratory source speed is variable to at least a speed of about 1500 rpm to simulate the vibrational frequency of an automobile.

A still additional object of the present invention is a child pacifying device having an amplitude of less than 0.12 inch.

A further object of the present invention is an attachment means Capable of attaching to a wide range of infant support structures for convenient attachment and removal of child pacifying device to and from the child carrier.

A further object of the present invention is an attachment means for a child pacifying device wherein the attachment means includes peripherally oriented tabs located on two opposing sides portions of the case structure and a mounting bracket further comprising recessed notches attachable to a substantially flat surface of an infant support structure, wherein the notches detachably engage the tabs of the attachment means.

A final object of the present invention is an attachment means for a child pacifying device wherein the attachment means includes a pivotable retaining arm, where one end of the retaining arm is adapted to engage virtually any exposed portion of the infant support structure and the opposite end is adapted to be manually manipulated against a biasing means to pivot the retaining arm into and out of engagement with the infant support structure.

These together with other objects and advantages will become subsequently apparent from the details of the following described embodiment and operations thereof, reference being had to the accompanying drawings forming a part thereof, wherein like numerals refer to like parts throughout.

BRIEF DESCRIPTION OF THE DRAWINGS

Reference may be made to the following drawings illustrating the preferred embodiment of the present invention:

FIG. 7 is a plan view of the mounting means of a first embodiment of the present invention;

FIG. 8 is a sectional view of the mounting means of a first embodiment of the present invention shown in FIG. 7 taken along the line 8—;

FIG. 9 is a side view of the mounting means of a first embodiment of the present invention shown in FIG. 7;

FIG. 10 is a plan view of the mounting means of a first embodiment of the present invention;

FIG. 11 is a sectional view of the mounting means of a first embodiment of the present invention shown in FIG. 10 taken along the line 11—11; and FIG. 12 is a side view of the mounting means of a first embodiment of the present invention shown in FIG. 10;

DETAILED DESCRIPTION OF THE PREFERRED EMBODIMENT

Figure 1:
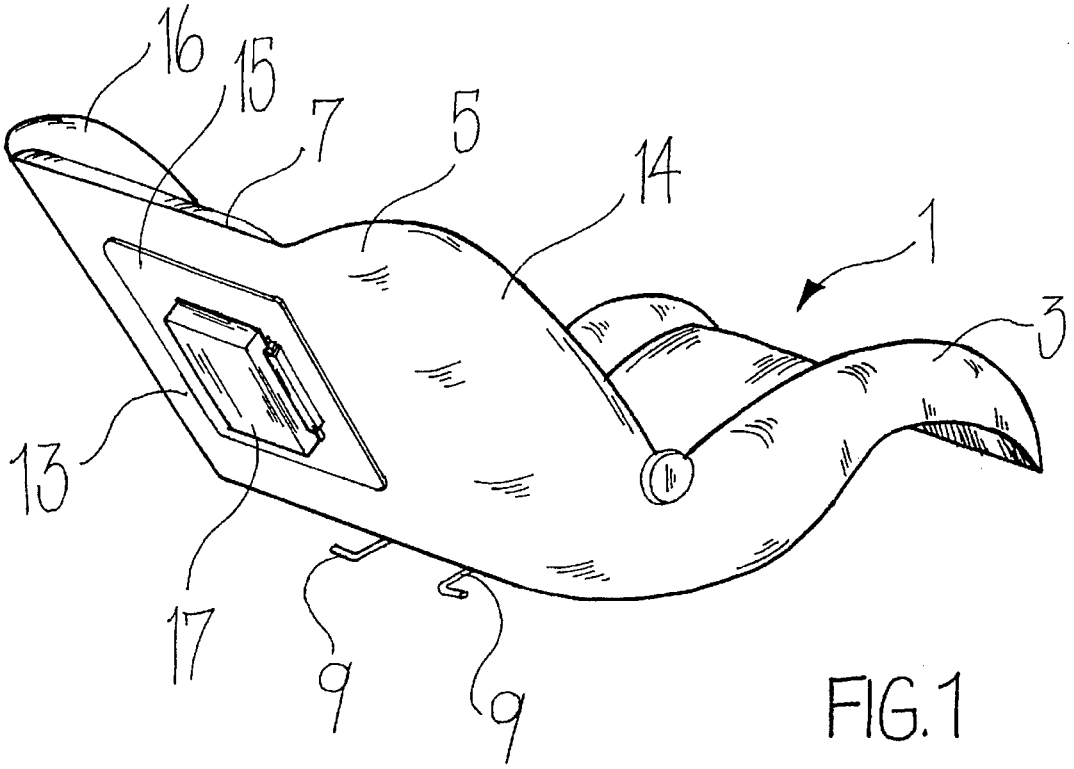
FIG. 1 a perspective view of an infant support structure with the mounting meaning and child pacifying device in accordance with a first embodiment of the present invention affixed thereto.

Referring now to the figures, where like character reference numbers depict like or similar features throughout the drawings, FIG. 1 shows an overall configuration of a first embodiment of the present invention as adapted to an infant support structure 1—in the case shown, an infant safety seat. The infant support structure 1 may be of two major portions, a bottom seat portion 3 and an upper back support portion 5, whereon a cushion 7 is provided to enhance the infant's comfort. The entire infant support structure 1 is further supported by a wire frame assembly 9, which allows the child carrier to be supported either on a flat surface or upon an automobile seat.

Defined by the rear of the upper back support portion 5 is a substantially flat surface 13 between two wing portions 14, 16, establishing an ideal surface to which the first embodiment of the present invention may be affixed. As shown in FIG. 1, the present invention comprises an attachment means 15 and a vibratory source 17.

Figure 2:
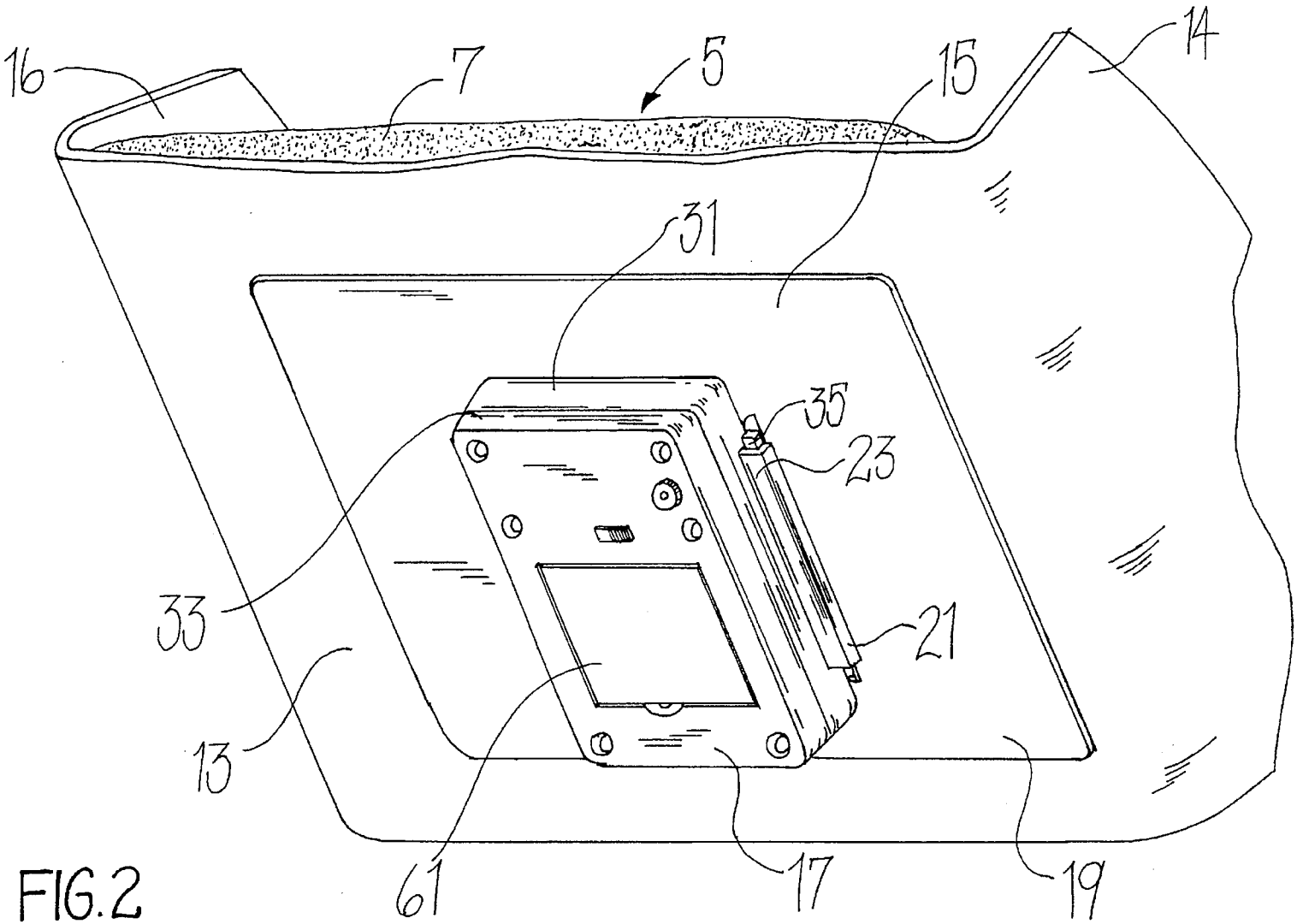
FIG. 2 is a further partial perspective view of an infant support structure with the mounting meaning and child pacifying device in accordance with a first embodiment of the present invention affixed thereto as depicted in FIG. 1, providing additional detail of the mounting means.

Referring to FIG. 2, the substantially flat surface 13, the attachment means 15, and the vibratory source 17 can be seen in greater detail. The vibratory source 17 is shown restrained by the attachment means 15 through a unique configuration.

The attachment means 15, as shown, can be a substantially flat planar sheet 19 of black ABS plastic, having an average thickness of 0.125 in. Shown in detail in FIGS. 7 through 9, the attachment means 15 is further provided with a pair of opposing projections 21, which extend away from the exposed surface of the planar sheet 19 by about 0.50 in. Each of the projections 21 have an inwardly projecting flange 23, extending inwardly about 0.25 in., each of the flanges 23 forming an internally oriented notch 25. Cutouts 27 are formed in the planar sheet 19 to facilitate molding of the projections 21 and flanges 23 during the forming process. A support 29 is also provided on the planar sheet 19 to restrain the vibratory source 17 in place against gravity during operation. The opposite surface 30 of the planar sheet 19 is permanently affixed to the substantially flat surface 13 of the infant support structure 1 with an appropriate adhesive or double stick tapes, such as those manufactured by 3M Company.

A portion of the attachment means 15 according to the first embodiment is preferably a U-shaped plastic injection molding 20 of black ABS plastic, having an average thickness of 0.125 in. Such a structure is easier to handle, easier to affix to the infant support structure 1 and allows the vibratory source 17 to directly abut the infant support structure 1, thereby increasing the effectiveness of the present invention.

Shown in detail in FIGS. 10 through 12, the molding 20 of the attachment means 15 is likewise provided with a pair of opposing projections 22, which extend away from the exposed surface of the molding 20 by about 0.50 in. Each of the projections 22 have an inwardly projecting flange 24, extending inwardly about 0.25 in., each of the flanges 24 forming an internally oriented notch 26. A support 28 is likewise also provided on molding 20 to restrain the vibratory source 17 in place against gravity during operation. The opposite surface 32 of the molding 20 is likewise permanently affixed to the substantially flat surface 13 of the infant support structure 1 with an appropriate adhesive or double stick tapes.

Again referring to FIG. 2, the vibratory source 17 includes an integral outer case structure formed by the two cooperating ABS plastic shells, a bottom housing unit 31 and upper housing unit 33, also having an average thickness of 0.125 in. The bottom housing unit 31 can be detachably restrained by the projections 21 and flanges 23 (or projections 22 and flanges 24) of the attachment means 15, within the notch 25 (or notches 26), through integrally molded tabs 35, extending outwardly about 0.30 in. and located on either side of the bottom housing unit 31 and situated to slidingly engage the notches 25 (or notches 26). The vibratory source 17 can thus be installed (or removed) by slidingly moving the vibratory source 17 downwardly (or upwardly), with the tabs 35 within the notches 25 (or notches 26), until the lower portion of the vibratory source 17 abuts the support 29 (or support 28). As will be explained below, the pacifying unit is restrained in this position throughout its use through the resilient biasing of a vibration amplitude dampening means 95.

Figure 3:
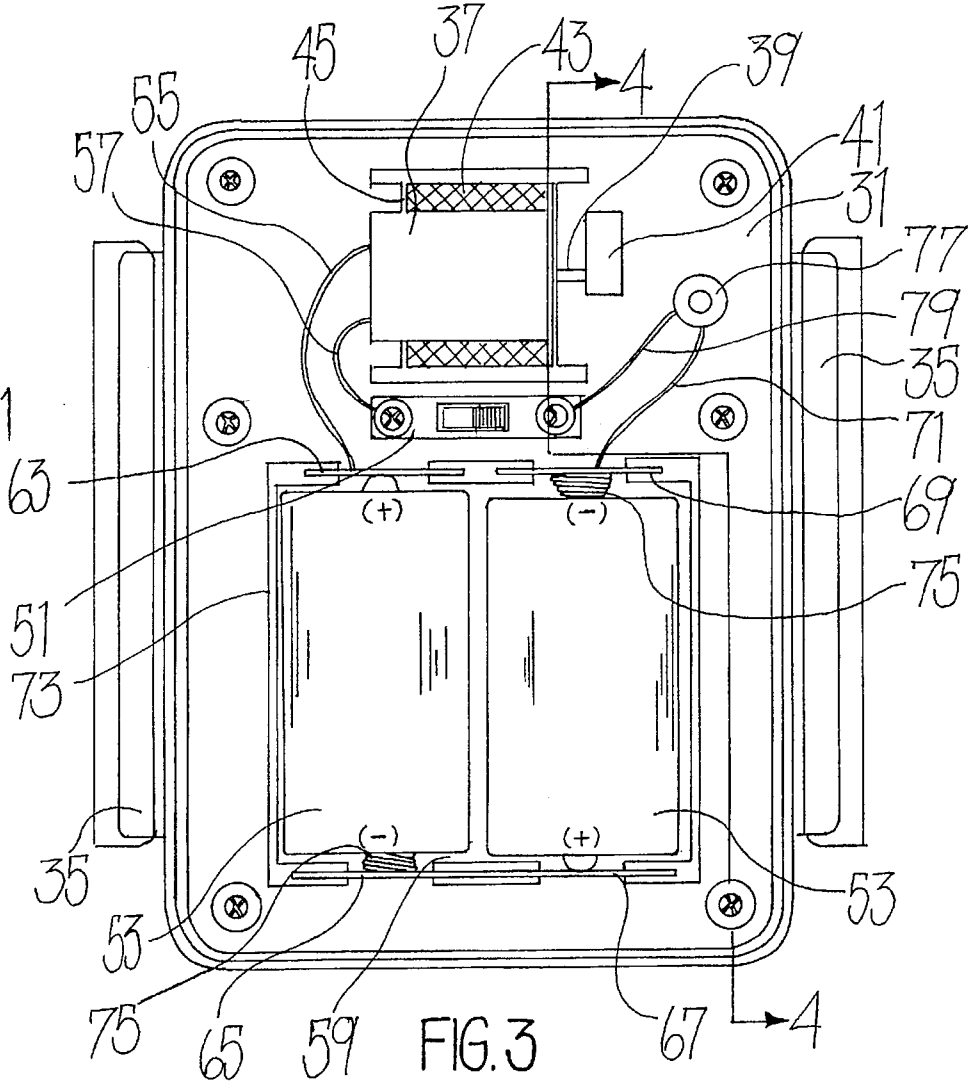
FIG. 3 is a plan view of the bottom housing unit of the child pacifying device of a first embodiment of the present invention, with the motor, batteries, switch, and structural details shown therein.
Figure 4:
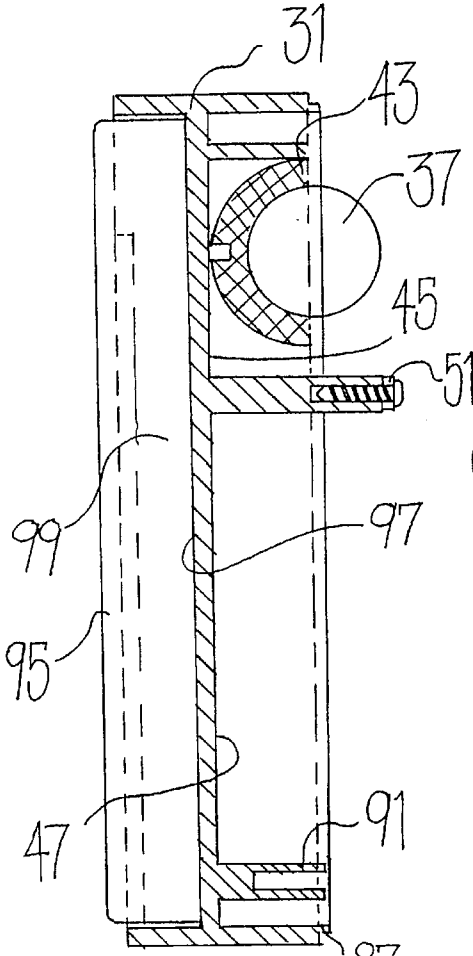
FIG. 4 is a sectional side view of the bottom housing unit of the child pacifying device of a first embodiment of the present invention shown in FIG. 3 taken along the line 4—4.

The bottom housing unit 31 is shown in greater detail in FIGS. 3 and 4, wherein several of the operational components of the present invention can be seen. One component is an internally mounted and battery powered variable speed electric motor 37 driving a shaft 39 having on the end thereon a single counterweight 41. An example of a suitable motor is the RS Series small motor manufactured by Mabuchi Company. The motor 37 is shown as being mounted within the bottom housing unit 31 (and similarly within the top housing unit 33) through a resilient ring 43 encircling the cylindrical motor, thus restraining the motor 37 within circumferential embossed notches 45 molded onto the interior surface 47 and 49 of the bottom housing unit and top housing unit, respectively. The resilient ring 43 is constructed from a dampening material, such as a rubber sleeve manufactured by Atlantic India Rubber Company, to reduce the gross oscillatory motion of the motor 37 and attenuate the vibrational harshness obtained from operation of the motor 37 and rotation of the counterweight 41.

The motor 37 is electrically connected to a switch 51 and a pair of "D" cell DC batteries 53 through leads 55, 57, respectively, provided thereon. It should be noted, of course, that other battery supply formats may be advantageously employed. The batteries 53 are placed in a compartment 59, accessible through a battery compartment panel 61 (best seen in FIG. 2) and connected in series with the lead 55, anode 63, cathode 65, anode 67, cathode 69, and rheostat lead 71, variable speed control rheostat 77, and return lead 79 to the switch 51. When the switch 51 is placed in the "ON" position, electrical current is provided to the motor 37 through this electrical circuit to rotate the counterweight 41. The anode 63, cathode 65, anode 67 and cathode 69 are held in position by bosses 73. Preferably, cathode 65 and anode 67 are made from a single conductive element. The batteries 53 are preferably retained in place through compression springs 75 as is typical of such units. Additionally, the variable speed control rheostat 77 potentiometer manufactured by Clarostat Manufacturing Company is added to the electrical circuit through leads 71, 79 to provide a measure of vibration frequency adjustability through control of the rotational speed of the counterweight 41.

Figure 5:
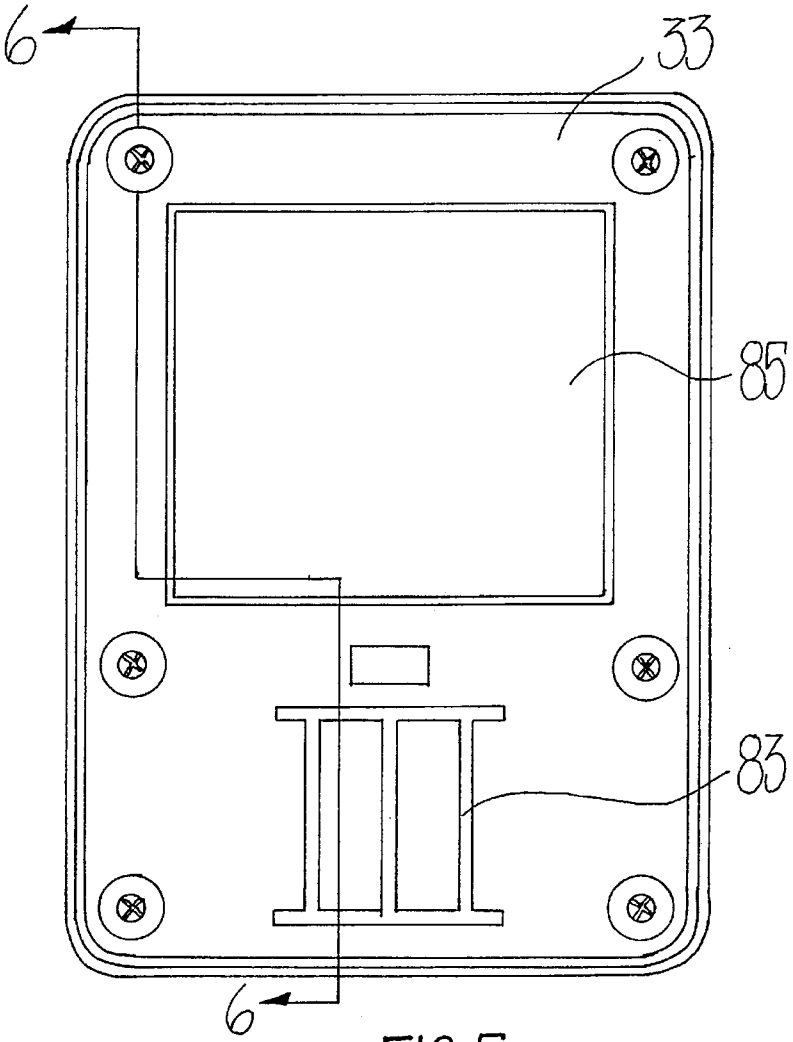
FIG. 5 is a plan view of the top housing unit of the child pacifying device of a first embodiment of the present invention.
Figure 6:
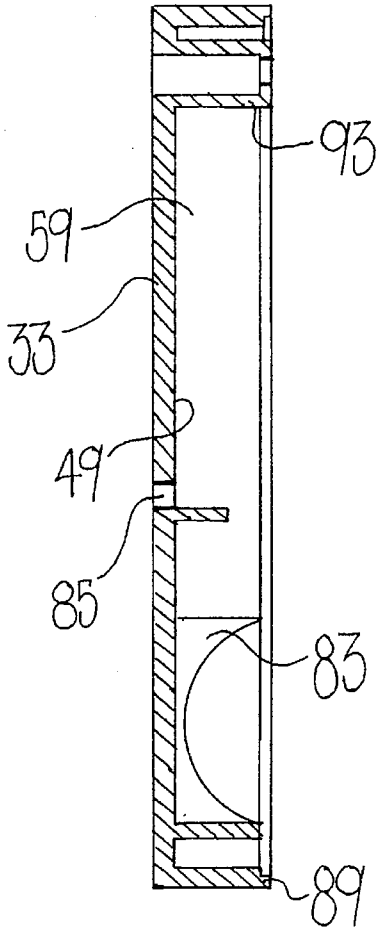
FIG. 6 is a sectional side view of the top housing unit of the child pacifying device of a first embodiment of the present invention shown in FIG. 5 taken along the line 6—6.

The top housing unit 33 is shown in greater detail in FIGS. 5 and 6. As noted above, the motor 37 mounted within the bottom housing unit 31 is similarly restrained within the top housing unit 33 through circumferential embossed notches 45 molded into the interior surface 49 of the top housing. The resilient ring 43, encircling the cylindrical motor 37 and thus restraining the motor 37 within circumferential embossed notches 45, is not shown. The battery compartment 59 is accessible through the battery compartment panel 61 (shown removed in FIGS. 5 and 6) and battery access portal 85.

The bottom housing unit 31 and the top housing unit 33 are mated through a "tongue and groove" interface provided about their outer shell edges 87, 89, respectively. This prevents moisture and dust from entering the interior of the vibratory source 17. The units 31 and 33 may be assembled through screw bosses 91 and seating bosses 93 located about the periphery of the pacifying unit. It is recommended that a screw locking compound, such as that manufactured by Locktite Corporation, be used to prevent screw loosening caused by the vibration of the unit during operation.

Alternately, and preferably, the screw attachment may be eliminated and a well known interlocking snap configuration (not shown) employed to mate the units 31 and 33. The benefits of such an arrangement would be reduction in the number of parts, further reduction in the physical size of the vibratory source 17, ease of assembly, and elimination of the screws, which if detached from the vibratory source 17 could be swallowed by a child.

The vibration amplitude dampening means 95 is preferably located on an abutting surface 97 opposite the interior surface 47 of the bottom housing unit 31, as shown in FIG. 4. The vibration amplitude dampening means 95 is thus proximate the motor to facilitate transfer of the vibratory motion of the counterweight 41. The vibration amplitude dampening means 95 is permanently affixed to the abutting surface 97 and is situated in a recess 99. The vibration amplitude dampening means 95 projects about 0.25 in. outwardly from the recess 99 and is placed in continuous abutting contact with the planar surface 19 of the attachment means 15 or the infant support structure 1, depending on the embodiment of the mounting means employed. As the vibration amplitude dampening means 95 is made of a dampening material, such as Ethafoam manufactured by Dow Chemical Company, it also is resilient and when compressed during attachment of the vibratory source 17 to the attachment means 15, remains compressed. This compression biases the tabs 35 within the notches 25 (or notches 26) against the flanges 23 (or flanges 24), thus firmly securing the vibratory sources 17 in place until it is desired to remove the vibratory source 17 from the attachment means 15.

Figure 14:
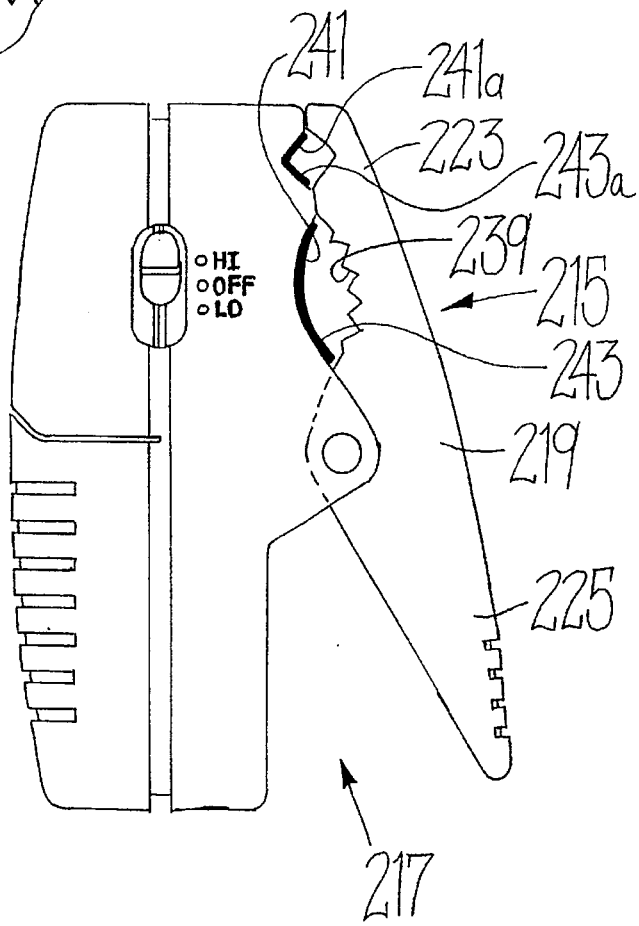
FIG. 14 is a side view of the outer casing structure of the child pacifying device of a second embodiment of the present invention.

FIG. 14 shows a second embodiment of the present invention. Here, the vibratory source 217 is integral with the attachment means 215. As better shown in FIG. 15, it can be seen that the interaction of the attachment means 215 and the vibratory source 217 is adapted to grab and hold on to an exposed portion of the infant support structure 1, such as one of the two wing portions 14, 16, establishing an ideal surface to which the second embodiment of the present invention may be affixed. Other locations on the infant support structure which allow the attachment member are contemplated within the scope of the present invention. Thus, the attachment means 215 allows the vibratory source 217 to universally attach to any portion of an infant support structure that could be engaged by a clamp (i.e., an edge of a child safety seat or the supports of a bassinet), thereby improving the range of applications and versatility of the invention.

Figure 16:
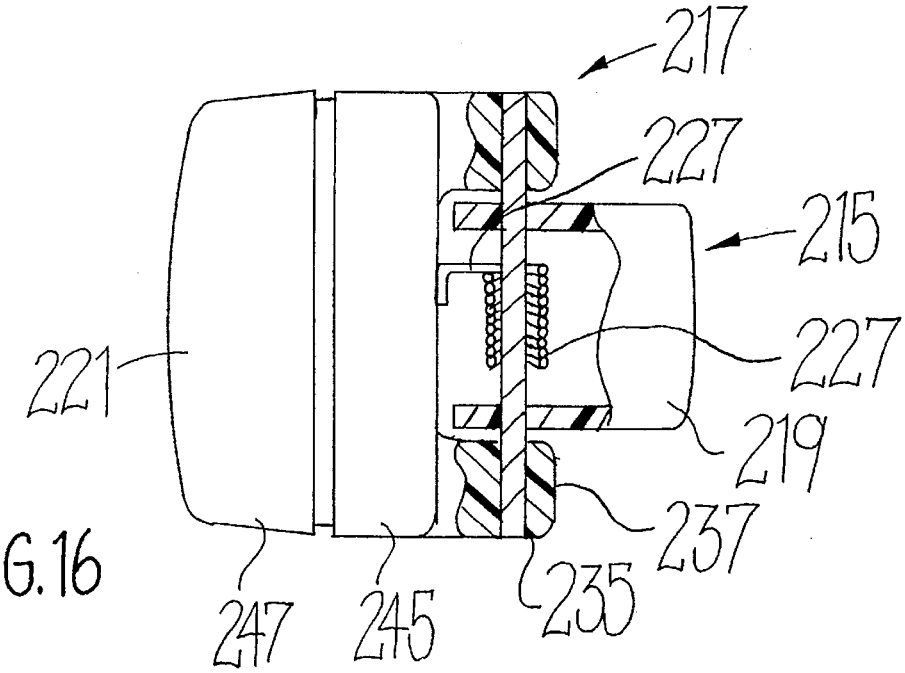
FIG. 16 is a top sectional view of the outer casing structure of the child pacifying device of a second embodiment of the present invention taken along the line 16—16 of FIG. 15.
Figure 15:
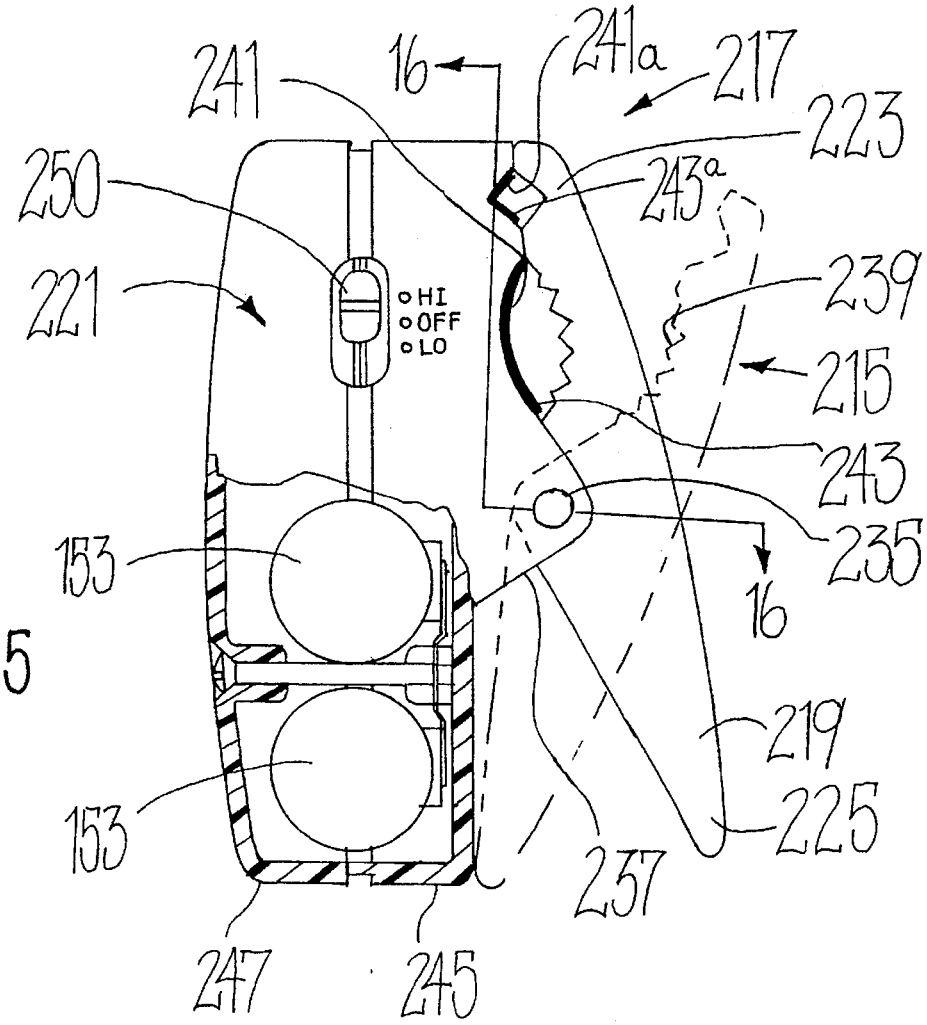
FIG. 15 is a partial side view of the outer casing structure of the child pacifying device of a second embodiment of the present invention, with a partial sectional view of the batteries and structural details shown therein.

Referring to FIGS. 14, 15, and 16, the vibratory source 217 and attachment means 215 can be seen in greater detail. The attachment means 215, as shown, includes a pivotable retaining arm 219 securely affixed to an outer case structure 221. A first end 223 of the retaining arm 219 is thus adapted to engage an exposed portion of the infant support structure 1, such as wing portion 14, while a second opposite end 225 of the retaining arm 219 is adapted to be manually manipulated to pivot the retaining arm into and out of engagement with the infant support structure 1.

Figure 18:
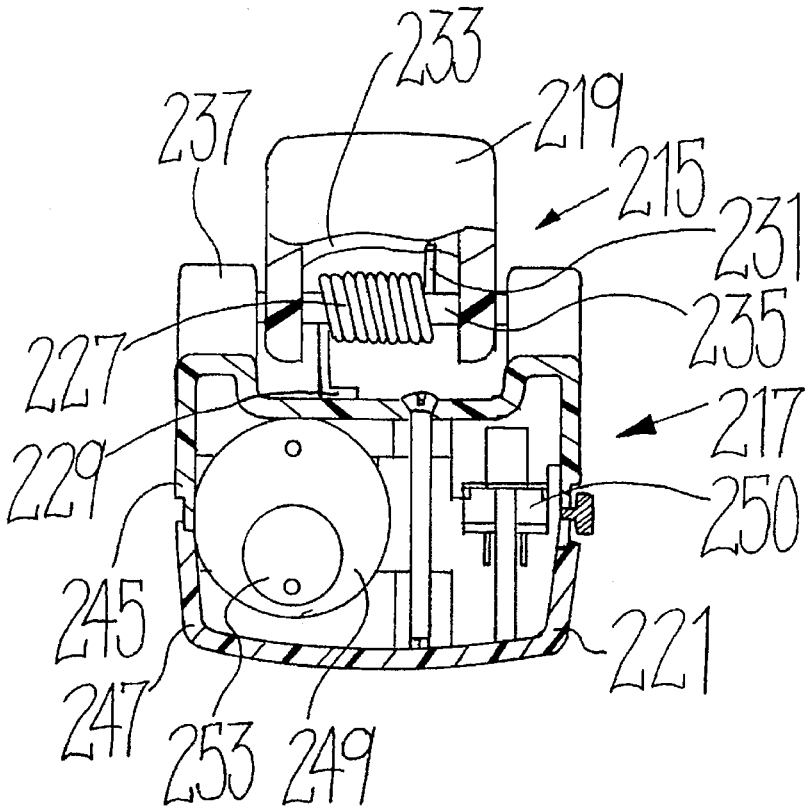
FIG. 18 is a top section view of the outer casing structure of the child pacifying device of a second embodiment of the present invention, taken along the line 18—18 of FIG. 17, with the motor, switch, and structural details shown therein.

A biasing means 227, preferably a torsion spring as shown in FIG. 16 and 18, is operative upon the retaining arm 219 to maintain the retaining arm 219 in engaging contact with the exposed portion of the infant support structure 1. A first end 229 of the spring is urged against the outer case structure 221, while a second end 231 is urged against the retaining arm 219. A support 233 on the retaining arm 219 forms a surface upon which the second end 231 of the spring 227 biases the first end 223 of the retaining arm into contact with the outer case structure 221 to form a clamp. As shown, the retaining arm 219 is pivotable about pin 235 secured by flange 237 of the outer case structure 221. Thus, pin 235 forms a pivot fulcrum integral with the outer case structure 221, securing retaining arm 219 to the outer case structure 221. The vibratory source 217 can be acted upon by manual compression of the second end 225 of the retaining arm 219 to disengage the entire device from the infant support structure 1 without the need for tools or other accessories.

As seen in FIGS. 14 and 15, the retaining arm 219 forms a first bearing surface 239. A portion of the outer case structure 221 proximate the pin 235 defines a second bearing surface 241. The exposed portion of the infant support structure 1 to be engaged by the attachment means 215 (e.g. the wing portion 14, not shown) is thus secured between the first bearing surface 239 and the second bearing surface 241. As further shown in FIGS. 14 and 15, the second bearing surface 241 is further provided with a dampening means 243, obtained from an elastomeric material such as neoprene rubber. The dampening means 243 between the second bearing surface 241 and the exposed portion of the infant support structure 1, such as the wing portion 14, dampens vibrations emanating from the vibratory source 217. An auxiliary second bearing surface **241*a* is preferentially provided with a similar dampening means 243*a*, also obtained from an elastomeric material such as neoprene rubber. The dampening means 243*a* between the second bearing surface 241*a* and the exposed portion of the infant support structure 1, such as the tubular member, likewise dampens vibrations emanating from the vibratory source 217**.

Figure 17:
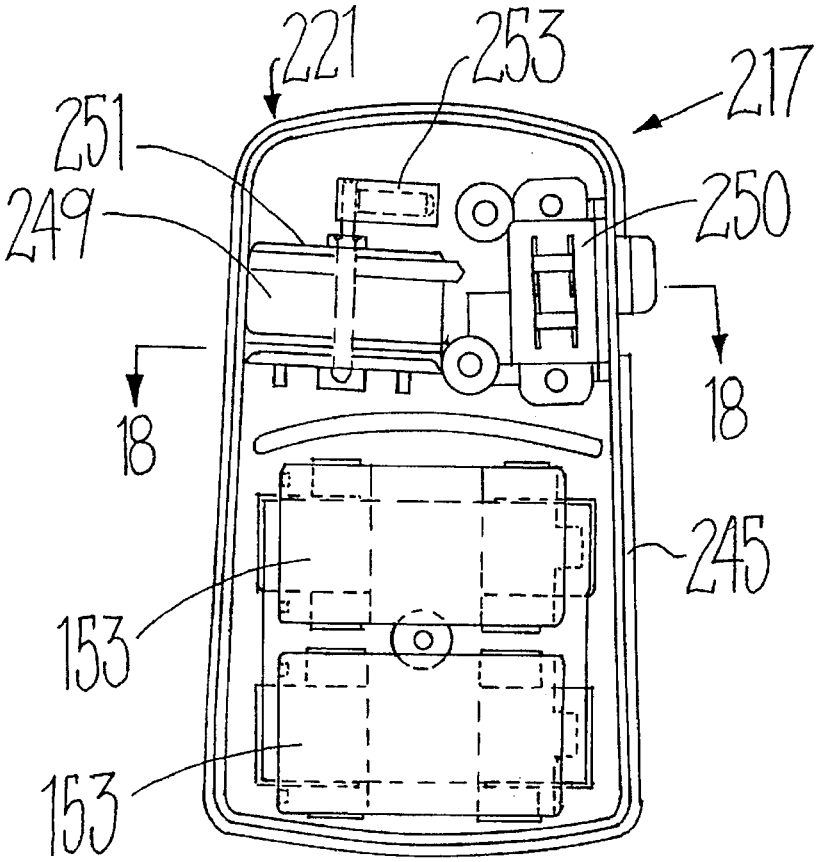
FIG. 17 is a plan front view of the bottom outer casing structure of the child pacifying device of a second embodiment of the present invention, with the batteries, motor, switch, and structural details shown therein.

Referring to FIGS. 17 and 18, 2, the vibratory source 217 includes an integral outer case structure 221 formed by the two cooperating ABS plastic shells, a bottom housing unit 245 and upper housing unit 247, having an average thickness of 0.125 in., joined in similar fashion as the corresponding components of the first embodiment.

The bottom housing unit 245 is shown in greater detail in FIG. 17, wherein several of the operational components of the present invention can be seen. One component is an internally mounted and battery powered variable speed electric motor 249 driving a shaft 251 having on the end thereof a single counterweight 253. An example of a suitable motor is the RS-500TB-18280 small motor manufactured by Mabuchi Company. The motor 249 is shown as being mounted within the bottom housing unit 245

Figure 13:
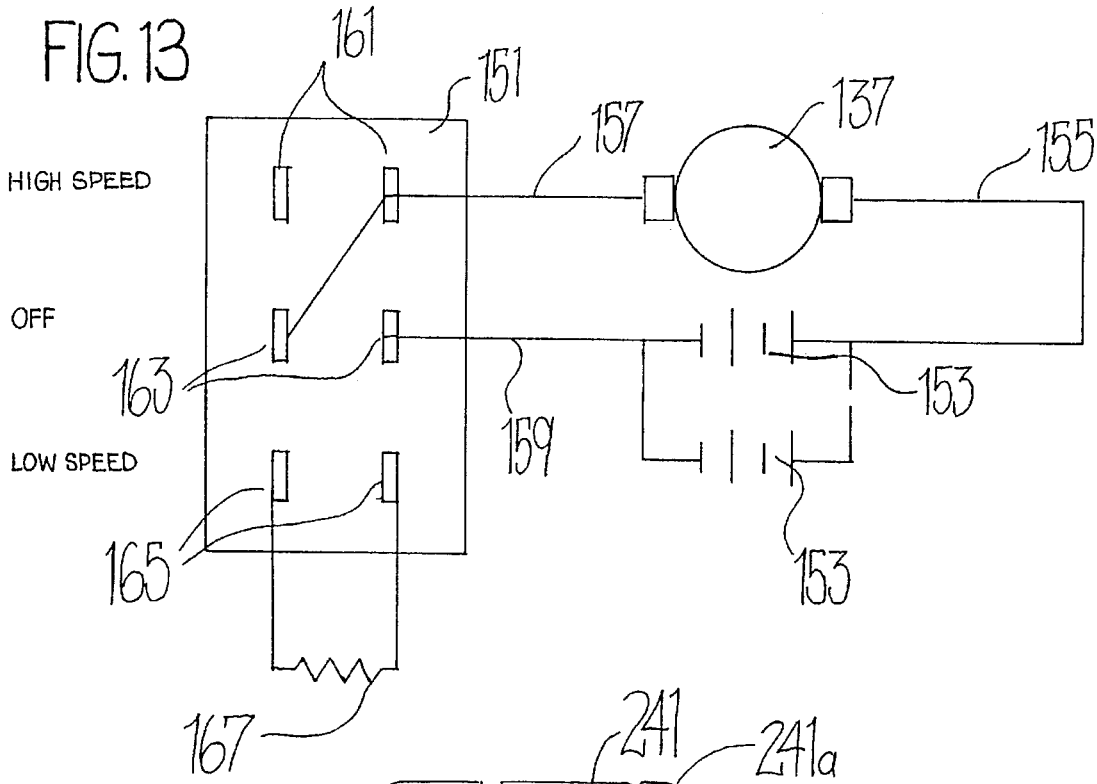
FIG. 13 is a schematic view of the circuit diagram of a second embodiment of the present invention.

An alternative electrical layout may be seen in FIG. 13, wherein the motor 249 is electrically connected to a two-speed switch 250 and a pair of "C" cell DC batteries 153 through leads 155, 157. When the switch 250 is placed in the "HIGH SPEED" position, electrical current is provided to the motor 249 through the electrical circuit including contacts 161 and 163 to rotate the motor 249 at a relatively high speed (e.g., 1500 rpm). However, when the switch 250 is placed in the "LOW SPEED" position, electrical current is provided to the motor 249 through the electrical circuit including contacts 161, 163 and 165, further including resistor 167 and reducing the voltage to the motor 249. Thus, the motor rotates the motor 249 at a relatively low (e.g., 1000 rpm).

As in the first embodiment, the operation of the rotating counterweight 253 imparts an oscillatory vibration to the motor 249, which in turn transmits this motion, to the structure of the vibratory source 217. The frequency of the motor 37 and 249 is preferably about 1500 rpm, which is intended to simulate the vibrational frequency of an automobile. A very small amplitude of no more than 0.12 inch is further preferred. The vibratory source 17 and 217 is thus set in oscillatory or vibrational motion in harmony with the motor 37 and 249 oscillation. The amplitude and, to a much lesser extent, the frequency are attenuated by the presence of the dampening material of the vibration amplitude dampening means 95 and 243. Thus, the gentle vibration caused by the vibratory source 17 and 217 in combination with the attachment means 15 and 215 according to the present invention will be sufficient to perform the desired soothing function, but not so great as to annoy the infant or cause the child carrier to "crawl" along a surface. When the device is turned on, an adult need not hold or secure the infant support structure, and the infant, secured in the infant support structure by a harness common to such support structures or through gravity in the presence of other securement means, will not be in danger of being thrown from the infant support structure by the vibration.

Thus, the embodiments of the invention herein described is adapted to be rigidly, yet detachably, mounted to virtually any infant support structure through an attachment means located provided with a vibration amplitude dampening means.

Moreover, the device according to the present invention does not require a vibratory source in combination with additional stimulatory sources, such as sound generators. Furthermore, the disadvantages of the prior art in soothing an uncomfortable child through a device rigidly attached to the supporting structure with no dampening material interposed between the device and the structure are avoided. Thus, the vibrations emanating from the devices of the prior art would be far harsher than those generated by the vibration source of the present invention due to the presence of the vibration amplitude dampening means 95 and 243. Also, the ability to remove and install a single pacifying device on several different infant support structures is uniquely accommodated by the present invention, as are the aforementioned objects of the present invention.

It will be understood that the details, materials and arrangements of the parts of a specific embodiment has been described to explain the nature of the invention. Changes may be made by those skilled in the art without departing from the invention as expressed in the appended claims.

What is claimed is:

1. A portable, compact, hand-held self-contained device for attachment to an exterior portion of an infant support structure for pacifying an infant, comprising:

an outer case structure within which an electrically driven and eccentrically mounted counterweight and a portable battery for driving the counterweight are operatively contained;

attachment means having a member integral with and permanently affixed to the outer case structure, the attachment means further including resilient biasing means for single-handed attachment of the device to and removal from the exterior potion of the infant support structure; and an amplitude dampening means disposed proximate the attachment means, whereby the dampening means is juxtaposed between the integral member of the attachment means and the portion of the infant support structure to transmit dampened vibrations emanating from the device;

the resilient biasing means biasing the integral member and the amplitude dampening means into contact with the child support structure, the biasing means allowing ready attachment and removal of the device to and from the infant support structure without the need for tools, fasteners or other accessories.

2. The device of claim 1, wherein the integral member comprises a pivotable retaining arm securely affixed to the outer case structure, a first end of the retaining arm adapted for clamping the exterior portion of the infant support structure by manual digital manipulation to pivot the first end of the retaining arm away from the outer case structure, whereupon the first end of the retaining arm is urged into clamping relation with the portion of the infant support structure, and a second opposite end of the retaining arm readily accessible for manual digital manipulation to pivot the retaining arm with respect to the exterior portion of the infant support structure and thereby clamping and unclamping the retaining arm, and the biasing means biasing the retaining arm in clamping relationship with the exterior potion of the infant support structure.

3. The device of claim 2, wherein the integral member further comprises a pivot fulcrum integrally disposed on the outer case structure, the retaining arm being secured to the outer case structure through the pivot fulcrum.

4. The device of claim 3, wherein the retaining arm defines a first bearing surface and a portion of the outer case structure defines second bearing surface, the exterior portion of the infant support structure being clamped between the first and second bearing surfaces;

the dampening means being disposed on the second bearing surface such that the dampening means is juxtaposed between the second bearing surface and the exterior portion of the infant support structure to dampen vibrations emanating from the device.

5. The child pacifying device of claim 3, wherein the biasing means comprises a torsional resilient member disposed about the pivot fulcrum and operative upon the retaining arm to bias the retaining arm into clamping relationship with the exterior portion of the infant support structure unless acted upon by manual digital compression to pivot the first end of the retaining arm away from the infant support structure and thereby unclamp the device from the infant support structure.

6. A portable, compact, hand-held self-contained device for attachment to an exterior portion of an infant support structure for pacifying an infant, comprising:

an outer case structure within which an electrically driven and eccentrically mounted counterweight and a portable battery for driving the counterweight are operatively contained;

attachment means having a member integral with and permanently affixed to the outer case structure, the attachment means further including resilient biasing means for single-handed attachment of the device to and removal from the exterior portion of the infant support structure, the integral member comprising a pivotable retaining arm securely affixed to the integral member of the outer case structure, a first end of the retaining arm for clamping about the exterior portion of the infant support structure and a second opposite end of the retaining arm for manual digital manipulation to thereby pivot the retaining arm toward and away from the exterior portion of the infant support structure;

an amplitude dampening means disposed proximate the attachment means, the dampening means juxtaposed between the integral member of the attachment means and the exterior portion of the infant support structure to dampen vibrations emanating from the device;

a pivot fulcrum integrally disposed on the outer case structure, the retaining arm being secured to the outer case structure through the pivot fulcrum; and the retaining arm defining a first bearing surface and a potion of the outer case structure defining a second bearing surface, the exterior potion of the infant support structure being clamped between the first and second bearing surfaces, and the second bearing surface having disposed thereon the dampening means such that the dampening means is juxtaposed between the second bearing surface and the exposed potion of the infant support structure to dampen vibrations emanating from the device;

the resilient biasing means urging the first end of the pivot arm and the amplitude dampening means into clamping relationship with the child support structure to maintain the retaining arm in clamping relationship with the exterior portion of the infant support structure unless the second end of the pivot arm is manually urged away from the exterior portion of the infant support structure by manual digital manipulation, thereby allowing attachment to and removal of the device from the infant support structure without the need for tools, fasteners or other accessories.

7. The device of claim 1, wherein the exterior portion of the infant support structure defines a substantially flat surface thereon;

the outer case structure being attachable to the substantially flat surface of the infant support structure through the attachment means;

an amplitude dampening means further comprising a elastomeric member disposed proximate the electrically driven and eccentrically mounted counterweight, the elastomeric member further being comprised of a dampening material;

the electrically driven and eccentrically mounted counterweight imparting an oscillatory vibration to the device such that the oscillatory vibration is primarily transmitted through the amplitude dampening means to the substantially flat surface of the infant support structure and to the infant support structure as a whole.

8. The invention of claim 1 wherein the infant support structure is a child safety seat suitable for use with automobile or airplane seats.

9. The invention of claim 7 wherein the device further comprises control means further comprising a rheostat to vary the speed of electrically driven and eccentrically mounted counterweight.

10. The invention of claim 9 wherein the device has an overall amplitude of no greater than 0.12 inch.

11. A portable, compact, hand-held self-contained for attachment to an infant support structure having a substantially flat surface thereon, comprising:

an outer case structure attachable to the substantially flat surface of the infant support structure through an attachment means;

a battery-operated electrically driven and eccentrically mounted counterweight and a battery for driving the eccentrically mounted counterweight operatively contained within the outer case structure;

the attachment means including a first member integral with and disposed on an exterior portion of the case structure and a second member fixedly attached to the substantially flat surface of the infant support structure, the second member detachably engaging the first member of the attachment means; and an amplitude dampening means disposed proximate the attachment means, the dampening means being juxtaposed between the attachment means and the infant support structure to dampen vibrations emanating from the vibratory source; and resilient biasing means associated with the attachment means, the biasing means urging the amplitude dampening means into contact with the child support structure and the biasing means facilitating single-handed manual attachment and removal of the attachment means to and from the substantially flat surface of the infant support structure without the need for tools, threaded fasteners or other accessories.

12. The invention of claim 11 wherein the first member of the attachment means further comprises symmetrically extending tabs, one each disposed on two opposing side portions of the case structure, and the second member of the attachment means further comprises inwardly recessed notches detachably engaging the tabs of the first member of the attachment means.

13. The invention of claim 12 wherein the second member of the attachment means further includes a support and the notches of the second member are defined by a pair of inwardly projecting flanges, the tabs of the first member slidingly engaging the notches for ready installation of the device by slidingly moving the outer case structure downwardly with the tabs within the notches until the outer case structure abuts the support.

14. The invention of claim 13 wherein the outer case structure is restrained in the installed position through the resilient biasing of the vibration dampening means.

15. The invention of claim 13 wherein the second member of the attachment means further comprises an abutting surface, the abutting surface of the second member of the attachment means being permanently affixed to the substantially flat surface of the infant support structure.

16. The invention of claim 15 wherein the abutting surface of the second member of the attachment means is permanently affixed to the substantially flat surface of the infant support structure with an adhesive.

17. A method for pacifying an infant, wherein the method comprises the steps of:

placing an infant in an infant support structure;

placing a portable, compact, hand-held self-contained device proximate the infant support structure, the device having an outer case structure, within which an electrically driven and eccentrically mounted counterweight and a portable battery for driving the counterweight are operatively contained;

attaching the device to the infant support structure through attachment means integral with and permanently affixed to the outer case structure, whereby the attachment means is urged into attaching relationship with the infant support structure through a resilient biasing means allowing single-handed attachment and removal of the device to and from the infant support structure without the need for tools, fasteners or other accessories;

activating the electrically driven and eccentrically mounted counterweight to transmit vibrations emanating from the device to the infant support structure; and dampening the vibrations to the infant support structure through an amplitude dampening means disposed proximate the attachment means, whereby the dampening means is juxtaposed between the integral member of the attachment means and the potion of the infant support structure, the resilient biasing means biasing the integral member and the amplitude dampening means into contact with the child support structure.

18. The method of claim 17, wherein the integral member comprises a pivotable retaining arm securely affixed to the outer case structure through an integral pivot fulcrum, the method further including the steps of:

pivoting a first end of the retaining arm by manual digital manipulation prior to attaching the device to the infant support structure away from the outer case structure by manual digital manipulation of a second opposite end Of the retaining arm readily accessible for such manipulation, and releasing the second end of the retaining arm, whereby the first end of the retaining arm is urged into clamping relation with the portion of the infant support structure through the biasing means.

19. In combination with an infant support structure having an exterior portion, a portable, compact, hand-held self-contained device attachable to the exterior portion of the infant support structure having an outer case structure within which an electrically driven and eccentrically mounted counterweight and a portable battery for driving the counterweight are operatively contained, attachment means having a member integral with and permanently affixed to the outer case structure, the attachment means further including resilient biasing means for single-handed attachment of the device to and removal from the exterior portion of the infant support structure, and an amplitude dampening means disposed proximate the attachment means, whereby the dampening means is juxtaposed between the integral member of the attachment means and the portion of the infant support structure to transmit dampened vibrations emanating from the device, the resilient biasing means biasing the integral member and the amplitude dampening means into contact with the child support structure, the biasing means allowing ready attachment and removal of the device to and from the infant support structure without the need for tools, fasteners or other accessories.

20. In combination with an infant support structure having an exterior portion, a portable, compact, hand-held self-contained device attachable to the exterior portion of the infant support structure having an outer case structure within which an electrically driven and eccentrically mounted counterweight and a portable battery for driving the counterweight are operatively contained, attachment means having a member integral with and permanently affixed to the outer case structure, the attachment means further including resilient biasing means for single-handed attachment of the device to and removal from the exterior potion of the infant support structure, the integral member comprising a pivotable retaining arm securely affixed to the integral member of the outer case structure, a first end of the retaining arm for clamping about the exterior portion of the infant support structure and a second opposite end of the retaining arm for manual digital manipulation to thereby pivot the retaining arm toward and away from the exterior potion of the infant support structure, an amplitude dampening means disposed proximate the attachment means, the dampening means juxtaposed between the integral member of the attachment means and the exterior potion of the infant support structure to dampen vibrations emanating from the device, a pivot fulcrum integrally disposed on the outer case structure, the retaining arm being secured to the outer case structure through the pivot fulcrum, and the retaining arm defining a first bearing surface and a portion of the outer case structure defining a second bearing surface, the exterior portion of the infant support structure being clamped between the first and second bearing surfaces and the second bearing surface having disposed thereon the dampening means such that the dampening means is juxtaposed between the second bearing surface and the exposed portion of the infant support structure to dampen vibrations emanating from the device, the resilient biasing means urging the first end of the pivot arm and the amplitude dampening means into clamping relationship with the child support structure to maintain the retaining arm in clamping relationship with the exterior portion of the infant support structure unless the second end of the pivot arm is manually urged away from the exterior portion of the infant support structure by manual digital manipulation, thereby allowing attachment to and removal of the device from the infant support structure without the need for tools, fasteners or other accessories.

21. An integrated, portable, compact, hand-held self-contained device for secure attachment to an exterior potion of an infant support structure for safely and conveniently pacifying an infant, comprising:

an outer case structure having an integral switch with an on and off position, a motor compartment and a battery compartment, the motor compartment housing an electrically driven and eccentrically mounted counterweight for creating a vibratory signal and the battery compartment housing a portable battery for powering the counterweight, the battery compartment further comprising a detachable battery compartment cover for access to and replacement of the battery;

attachment means having a member integral with and permanently affixed to the outer case structure, the attachment means further including resilient biasing means for single-handed attachment of the device to and removal from the exterior potion of the infant support structure; and an amplitude dampening means disposed proximate the attachment means, whereby the dampening means is juxtaposed between the integral member of the attachment means and the portion of the infant support structure to transmit dampened vibratory signals from the device when the switch is in the on position;

the resilient biasing means biasing the integral member and the amplitude dampening means into contact with the child support structure, the biasing means allowing ready attachment and removal of the device to and from the infant support structure without the need for tools, fasteners or other accessories.

* * * * *